US006576046B2

(12) United States Patent
Pruette et al.

(10) Patent No.: US 6,576,046 B2
(45) Date of Patent: Jun. 10, 2003

(54) MODULAR ELECTROSTATIC PRECIPITATOR SYSTEM

(75) Inventors: Dean B. Pruette, Sanford, NC (US); Charles A. Rector, Chapel Hill, NC (US); David R. Phelps, Greensboro, NC (US)

(73) Assignee: Fedders Corporation, Liberty Corner, NY (US)

( * ) Notice: Subject to any disclaimer, the term of this patent is extended or adjusted under 35 U.S.C. 154(b) by 0 days.

(21) Appl. No.: 09/964,055

(22) Filed: Sep. 26, 2001

(65) Prior Publication Data

US 2002/0069760 A1 Jun. 13, 2002

Related U.S. Application Data

(60) Provisional application No. 60/241,599, filed on Oct. 19, 2000.

(51) Int. Cl.[7] ..... B03C 3/72

(52) U.S. Cl. ..... 96/26; 96/60; 96/73; 96/86; 96/87; 96/100

(58) Field of Search ..... 96/26, 86, 87, 96/100, 73, 60, 64

(56) References Cited

U.S. PATENT DOCUMENTS

| | | | | | |
|---|---|---|---|---|---|
| 4,290,788 | A | * | 9/1981 | Pittman et al. | 96/86 |
| 5,071,455 | A | * | 12/1991 | Abedi-Asl | 96/86 X |
| 5,433,772 | A | * | 7/1995 | Sikora | 96/87 |
| 5,669,963 | A | * | 9/1997 | Horton et al. | 96/87 X |
| 6,096,119 | A | * | 8/2000 | Ho et al. | 96/87 X |

* cited by examiner

*Primary Examiner*—Richard L. Chiesa
(74) *Attorney, Agent, or Firm*—Welsh & Katz, Ltd.

(57) ABSTRACT

A modular two-stage electrostatic precipitator for extracting airborne particles includes individual ionizer/collector cell modules having integrated power supplies and diagnostic systems. The cell modules are adapted to be joined blindly to one another in end-to-end nested relation through nestable end plates and in a series circuit utilizing floating electrical connectors. The module end plates provide self-correction in misalignment during a blind connection and provide sealed end plate cavities for the power supply and electrical connections. The diagnostic system provides detection for any open system circuit and/or short circuit condition and allows for trouble shooting on an individual cell module basis.

37 Claims, 10 Drawing Sheets

MODULAR ELECTROSTATIC PRECIPITATOR SYSTEM

This application claims priority to provisional application Serial No. 60/241,599, filed Oct. 19, 2000, which is incorporated herein by reference.

BACKGROUND OF THE INVENTION

1. Field of the Invention

The present invention relates generally to devices for removing smoke, dust and fumes from the air, and more particularly to a novel modular electrostatic precipitator (ESP) system having among its features the employment of modular ionizer/collector cells that facilitate mechanical nesting of individual cell modules, fault detection at the individual cell level, and a high voltage source for each modular ionizer/collector cell so as to enhance overall system air cleaning efficiency.

2. Description of Related Art

Conventional two-stage ESPs are energized by a power supply source having a single, alternating current (AC) input voltage and a single or dual, direct current (DC) output voltage. Input voltages can range from 24 v to 240 v, and output voltages can range from 3 Kv to 15 Kv. A single output voltage power supply electrically connects the same high voltage potential to the ionization and collection section of an ESP. A dual output voltage power supply provides different levels of high voltage potential to the ionization and collection section, with the ionization section approximately twice the voltage level of the collection section. For example, a dual output voltage power supply that generates a high voltage level of 12 Kv to the ionization section will supply approximately 6 Kv to the collection section.

Each power supply or combinations of power supplies in conventional ESP systems are located in an enclosure, separate from the ionization and collection section of the ESP. These enclosures can be in proximity to the ESP, for example, on the ESP access panel, or the enclosure can be remote mounted a distance from the ESP. High voltage electrical connections between power supply and ESP are made by an insulated cable or wire, sized to carry the maximum electrical load. Electrical conduit is required to shield and protect the high voltage cable or wire when the power supply enclosures are mounted in a remote location. Once connected to the ESP, various conductive devices such as springs, plungers, cables, wires, or buss bars transfer high voltage between multiple ionization/collection sections (known as a cell or module). Each device is isolated from ground by a non-conductive material such as a fiberglass reinforced plastic (FRP) or ceramic. The cell-to-cell high voltage connections are located at each end of the cell and are shielded or baffled from the air stream to prevent contamination or corrosion. A tie rod or expanded tube is conventionally used to transfer high voltage through an individual cell. A series of individual cells are trained together to form a tier of cells. Each cell on a tier slides on a rail. Multiple tiers can be stacked vertically to complete the final ESP configuration.

The relationship between the current draw of a single cell, typically measured in milliamps, and the total current capacity of the power supply determines the number of cells that can be powered by one power supply. For example, a power supply rated for 10 milliamps can power 5 cells that draw 2 milliamps each. The number of cells or modules required for an ESP is dependent on the volume of air being moved in cubit feet per minute (CFM) and the desired efficiency (percentage of particles removed from air). After determining the number of cells required for an ESP based on this criteria and the total current draw for the cells, the number of power supplies required can be determined.

There are several disadvantages to the aforedescribed prior ESP and power supply arrangement. For example, the larger the ESP, the more difficult and expensive the high voltage wiring becomes between the power supplies and the cells. Power supply enclosure quantity, size and expense increase with the increase in size of the ESP. High voltage connection points and transfer devices required increase in number with increasing size of the ESP, thereby adding additional expense. Each high voltage connection point or transfer device must be electrically sound. Weak high voltage connections result in decay and failure of surrounding materials caused by arcing or corona stress. On conventional ESP's, an operating status light is used as a diagnostic device. For example, an LED is frequently provided as part of the power supply circuitry. Under normal operating conditions the LED will illuminate, indicating that the ESP and power supply are functioning properly. In a fault condition, however the LED does not illuminate so that trouble-shooting and isolating individual component failure becomes more difficult because the only device used for detection is part of the power supply. For example, the LED, being connected in circuit with the failed power supply, will not indicate which cell, if any, has a problem. On a conventional electrostatic precipitator, one power supply energizes multiple ionizer/collector cells. Under this arrangement, a power supply failure would result in the loss of power to a group of cells and greatly reduce the air cleaning efficiency of the electrostatic precipitator. As an added expense, volt and amp meters can be provided in addition to the operating status light, for increased operational monitoring of the ESP. On ESP's that utilize a rail system configuration, clearance for sliding of the cell is provided between the sides of the rail and cell. This clearance, usually one sixteenth to one quarter inch, generally creates misalignment between cells in a tier. Any high voltage connections between cells must compensate for the misalignment.

BRIEF SUMMARY OF THE INVENTION

One of the primary objects of the present invention is to overcome the aforementioned problems in known modular electrostatic precipitators (ESPs) by eliminating the high voltage components required for installation, and providing fault detection at the individual cell level in a cost-effective manner so as to enhance ESP performance.

A more particular object of the present invention is to provide a system of modular ESP cells wherein the cells can be supported in tiers and a power supply is united into the body of each cell so that all high voltage components are contained and isolated within the cell, thereby eliminating high voltage connections between cells, high voltage cabling between the ESP and a remote mounted power supply, and power supply enclosures.

Another object of the invention lies in providing each ESP cell with an alarm circuit and status indicator display for monitoring the normal operation of each cell, and wherein a tier of cells connects in series the alarm circuit from each cell, and a status indicator light monitors each tier of cells so that under normal operating conditions, a signal energizes each tier alarm circuit and illuminates the tier status indicator light.

In accordance with one feature of the invention, the alarm circuit energizing signal is carried through the tier to each cell so that when a fault is detected in a cell or power supply, for example, if high voltage plates in the collector section of a cell are shorted to ground, the alarm circuit for that cell will open or become de-energized and the cell status indicator will not be illuminated. Such open circuit condition to a tier of ESP cells causes the status indicator light for the tier to become non-illuminated.

In accordance with another feature of the invention, the status circuit also detects whether input power is connected to the cell power supply, and monitors cell arcing.

In accordance with another feature of the invention, a tier auxiliary status port is provided whereby connection to external devices for monitoring tier status can be effected.

Still another feature of the ESP modules in accordance with the invention lies in the provision of a low voltage (24 v–240 v) input power distribution network that utilizes a radial float "blind mate" connector (RFC) that is also used in the cell status circuit and is particularly suited for conventional ESP applications that require low voltage electrical connections between cells that may become misaligned in a support frame.

In accordance with the invention, the ESP cell modules are adapted for mechanical nesting in a manner to correct misalignment for electrical connections between cells when placed in series on a support rack, and when nested provide sufficient air baffling between cells to protect exposed high and low voltage electrical components. To this end, end plates on the modular ESP cells are adapted for end-to-end nesting so as to form a sealed cavity in which electrical components such as power supplies can be enclosed. The sealed cavity also serves as a baffle, forcing air-borne particles through the ionization and collection sections of the cell and preventing bypass between cells.

DETAILED DESCRIPTION OF THE INVENTION

Figure 1:
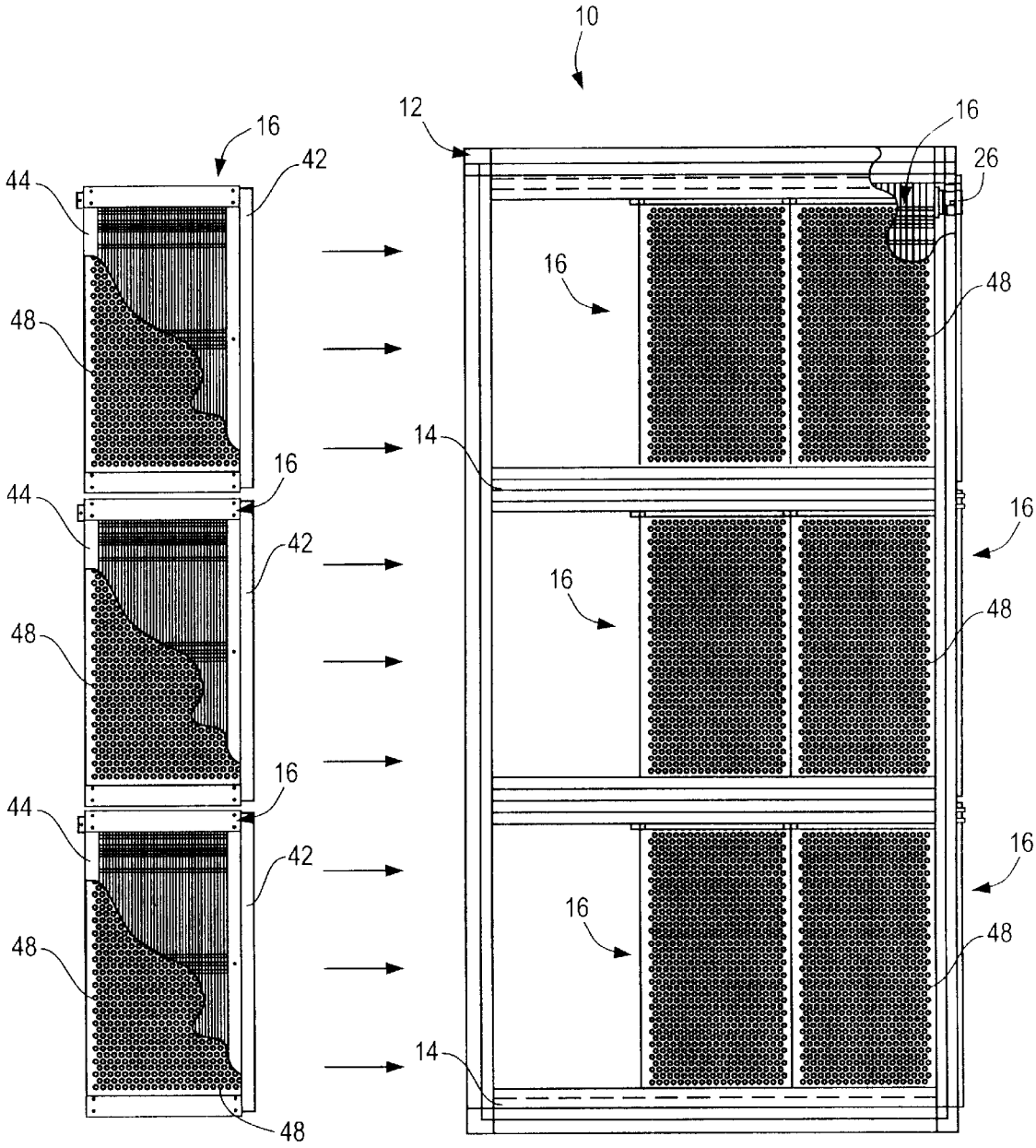
FIG. 1 is a front elevational view of an electrostatic precipitator system constructed in accordance with the present invention and showing modular ionizer/collector cells supported on a support rack in nested relation, with other cells positioned for placement on the rack.

Referring now to the drawings, and in particular to FIG. 1, a representative electrostatic precipitator (ESP) system in accordance with the present invention is indicated generally at 10. Briefly, the electrostatic precipitator system 10 includes an open framework rack 12 having horizontal rails 14 adapted to receive and support a plurality of modular two-stage ionizer/collector cells, indicated generally at 16, in horizontal rows or tiers. As will be described, the modular two-stage ionizer/collector cells 16, which may for simplicity be referred to hereinafter as modular cells, are generally rectangular and each includes a pair of substantially rectangular male and female end plates 18 and 20, respectively, between which are disposed a plurality of parallel spaced high voltage charged collector plates 21 and grounded plates 23 supported in alternating sequence on suitable transverse tie rods or support rods, insulators and spacers so as to form the collection section of each cell with each plate in the sequence having opposite polarity to the next adjacent plates, as is known. Ionizing wires, indicated at 25 in FIG. 5, and extended ground plates, 23*a* are provided in a manner to generate corona current toward the extended ground plates 23*a* and thus form an ionization section of high concentration ion curtains in a conventional manner. Air-borne particles passing into the ESP cell 16 must go through the high concentration ion curtains before entering the precipatory plate collection section of cells, and are charged as the particles pass through the ion curtains as disclosed in, for example, U.S. Pat. No. 6,096,119 which is incorporated herein by reference.

Figure 5:
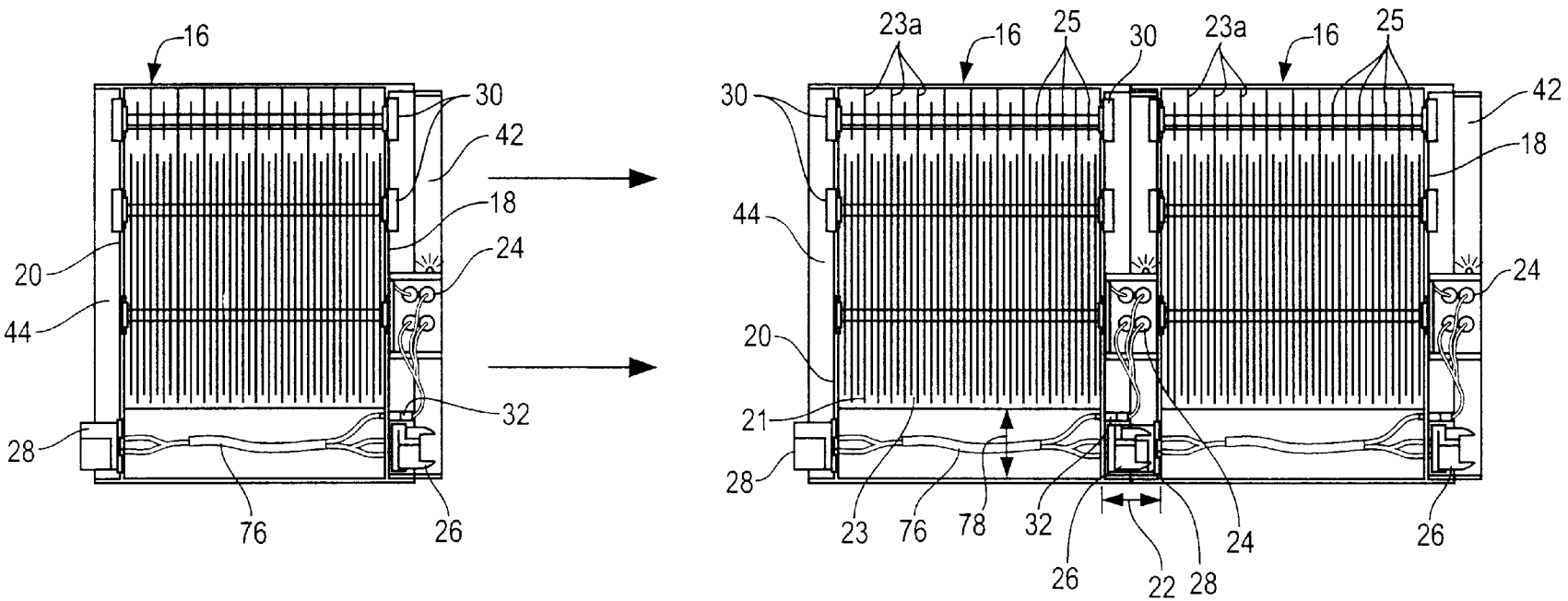
FIG. 5 is a plan sectional view of a representative electrostatic precipitator system illustrating the manner of mechanically and electrically connecting modular ionizer/collector cells together.

The end plates 18 and 20 facilitate nesting relation between adjacent modular cells when supported in the rack 12. As shown in FIG. 5, when the male and female end plates 18 and 20 of adjacent modular cells are disposed in nested relation, they form a sealed cavity 22 between the adjacent cells that houses a power supply 24, radial float blind mate connectors 26 and 28 that facilitate distribution of control power and operating status signals through the nested cells, high voltage insulators 30, a power supply connector 32, a high voltage cable 34 and a low voltage cable 36.

Figure 2:
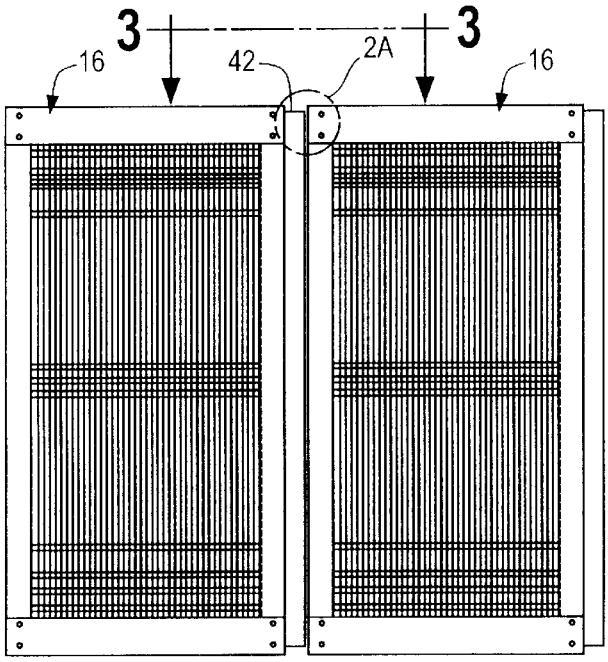
FIG. 2 is a front elevational view showing two modular ESP cells being mechanically nested together, each cell having its pre-filter removed.
Figure 2A:
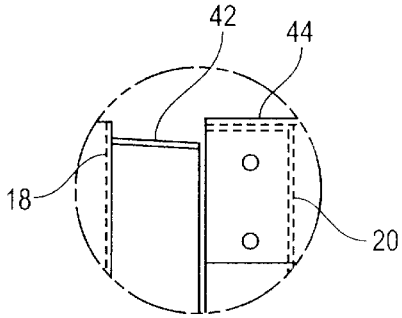
FIG. 2A is a detail view, on an enlarged scale, of the portion of FIG. 2 encircled by line 2A—2A.
Figure 3:
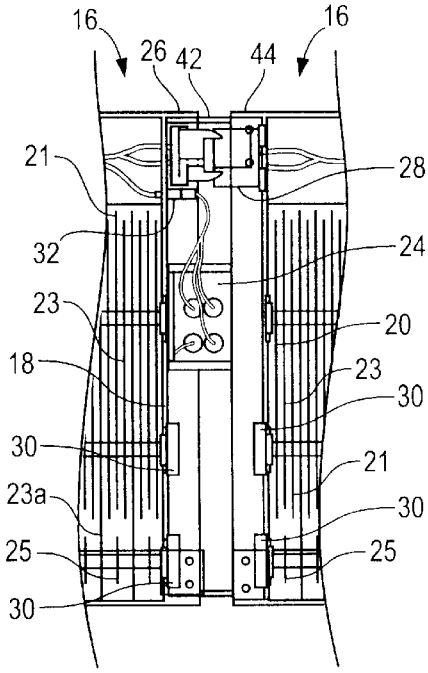
FIG. 3 is a fragmentary plan view taken along line 3—3 of FIG. 2, portions being broken away for clarity.
Figure 4:
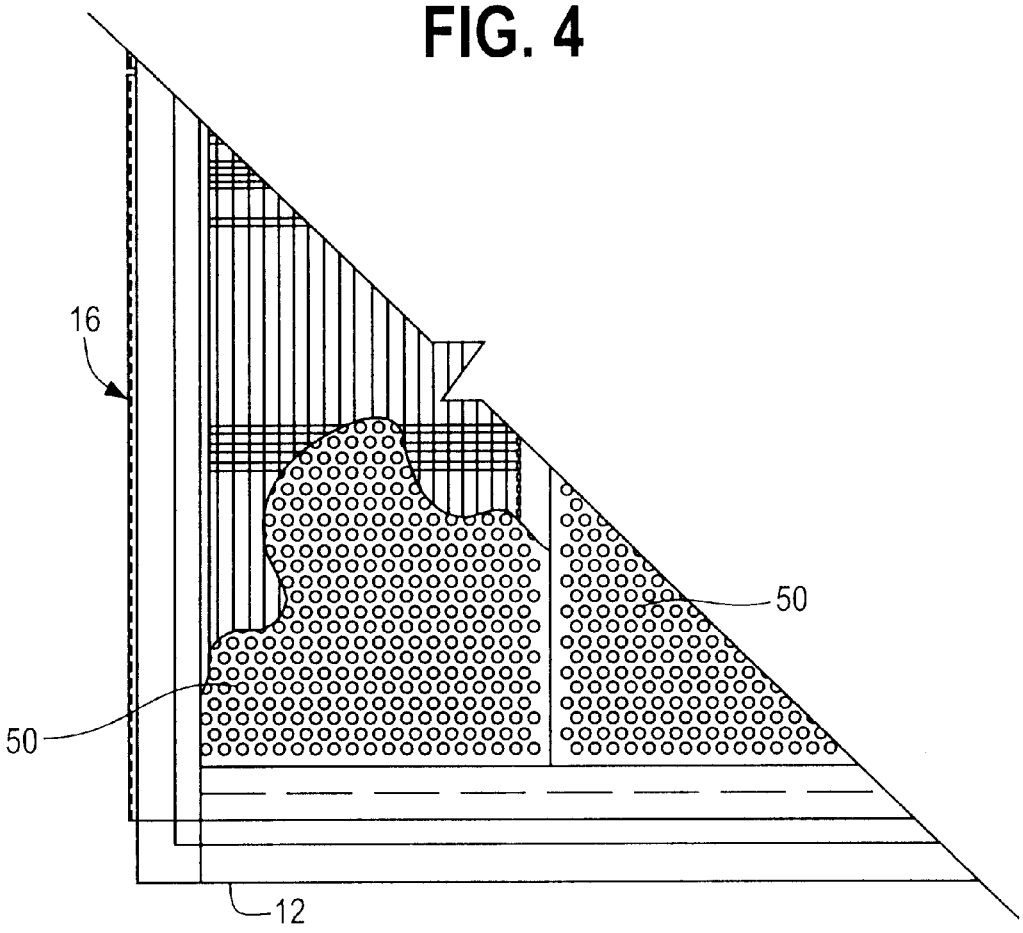
FIG. 4 is a fragmentary elevation view of the discharge side of an ionizer/collector cell, the conductive perforated post filter being broken away for clarity.
Figure 8:
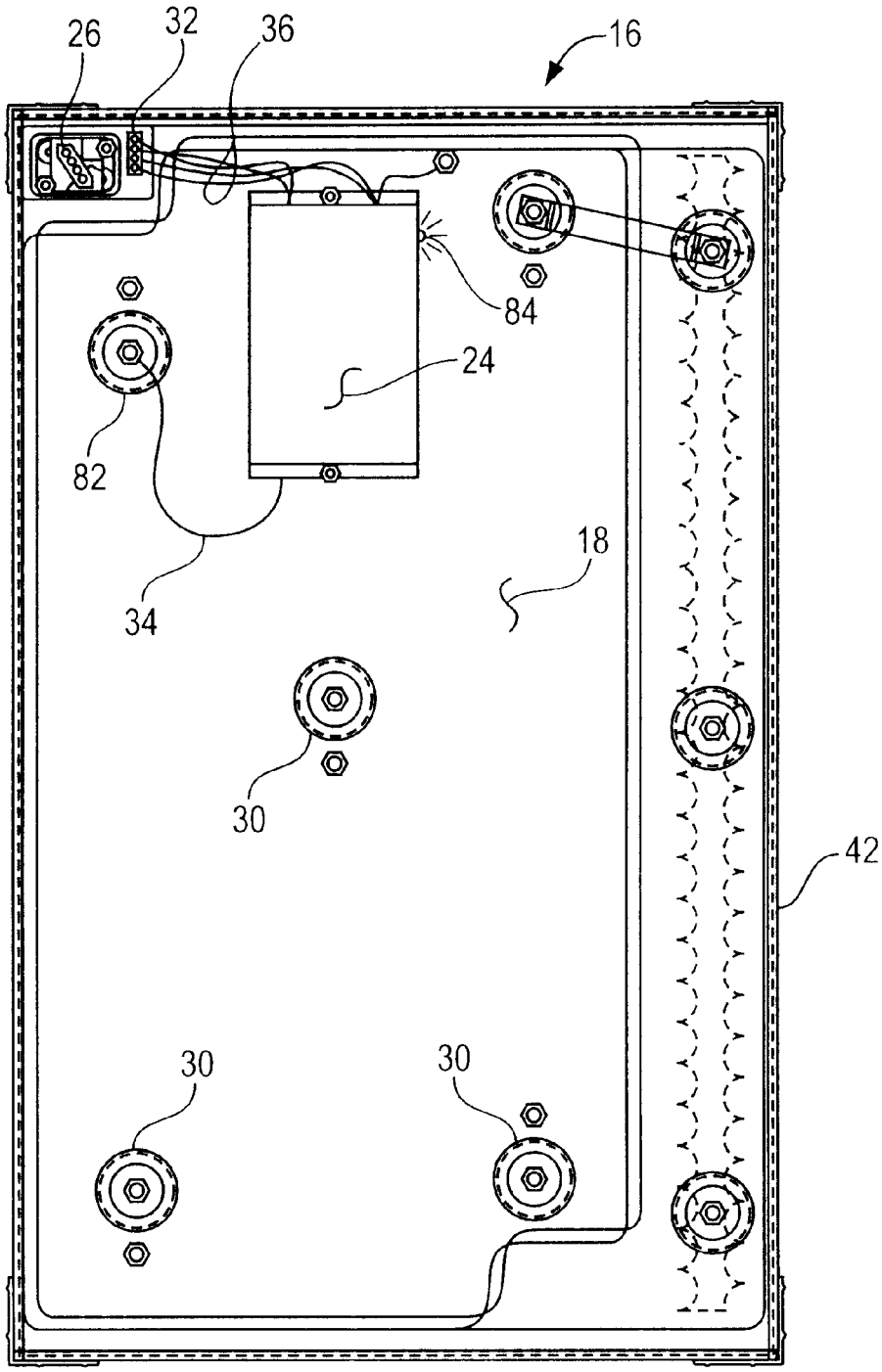
FIG. 8 is an elevational view of an ionizer/collector cell male end plate showing integrated power supply, cell status indicator, and low & high voltage connections.

As illustrated in FIGS. 2, 2A and 8, the ionizer/collector cell male end plate 18 has a male flange 42 that extends about the full periphery of the rectangular end plate 18 and is tapered inwardly from its connection to the planar end plate, as shown in FIG. 2A. The female end plate 20 has a similar female flange 44 that extends about the full periphery of the planar end plate 20 but is normal to the end plate 20. The flange 42 is tapered sufficiently to enable it to enter into and nest with the flange 44 of an adjacent cell 16 when the cells are positioned on and pushed together along a pair of laterally spaced parallel rails 14 on the rack 12 so that flanges 42 and 44 mate and form a sealed cavity 22 between the nested cells. The male flange 42 is tapered sufficiently to enter the female flange 44 and thereby accommodate initial mechanical misalignment between adjacent cells as they are positioned on and slid along rack rails.

When the male flange 42 of end plate 18 of one ionizer collector cell 16 fully mates with the female flange 44 of end plate 20 of an adjacent ionizer/collector cell 16, a complete air baffle between the adjacent cells is created, thus eliminating the requirement for external air baffles. As aforedescribed, with adjacent ionizer/collector cells 16 fully mated, a sealed cavity 22 is formed to house the integrated power supply 24, radial float "blind mate" connectors 26 and 28, high voltage insulators 30, power supply connector 32, high voltage cable 34, and low voltage signal cable 36. The sealed cavity thus provides a contaminate free environment for all housed electrical components.

Each of the modular ionizer/collector cells 16 includes a perforated pre-filter 48 and a perforated post-filter 50. As shown in FIG. 1, the pre-filter 48 is rectangular and mechanically attached to the air intake side or face of a modular cell 16 so as to cover the air intake side. The pre-filter 48 is made from a non-conductive material such as, for example, polyethylene plastic, that prohibits any corona field interruption between the ionizers (specially addressing spike blade ionizers) and ground. The perforated post-filters 50 are also rectangular and are mechanically attached to the air exiting or discharge faces of the ionizer/collector cells 16. The post-filters 50 are made from conductive metal material, such as aluminum, and become grounded potential collector plates for attracting and collecting positive or negative charged air borne particulate, thus increasing the ionizer/collector cell air cleaning efficiency and loading capacity. Both the pre-filters 48 and post-filters 50 are attached to the frames of their respective ionizer/collector cell air intake and air discharge faces with conventional quick release hardware to facilitate removal for ionizer/collector cell cleaning. The pre-filters and post-filters eliminate the need for air-baffling components that are normally required on the air intake and air discharge faces of conventional electrostatic precipitators.

FIG. 5 schematically illustrates the electrical connection technique and apparatus, alternatively termed the input power distribution network, for distributing low voltage (24 V–240 V) input power and operating status signals through two adjacent modular ionizer/collector cells 16 which is representative of the manner of distributing input power and operating status signals through a tier of cells. Each ionizer/collector cell 16 is equipped with radial float "blind mate" connector means in the form of a radial float plug connector 26 and a fixedly mounted receptacle connector 28. Each cell has a plug connector 26 mounted on one of its end plates 18 and 20, such as male end plate 18, and has a receptacle connector 28 mounted on the opposite end plate, such as female end plate 20. The plug connector 26 and receptacle connector 28 are mounted on their respective end plates 18 and 20, such as at corner locations as the end plates are considered in elevational end views, so that when adjacent modular cells are brought into substantially axial alignment with the male end plate of one cell facing the female end plate of the next adjacent cell, the corresponding plug and receptacle connectors face each other in substantially aligned relation.

Figure 7:
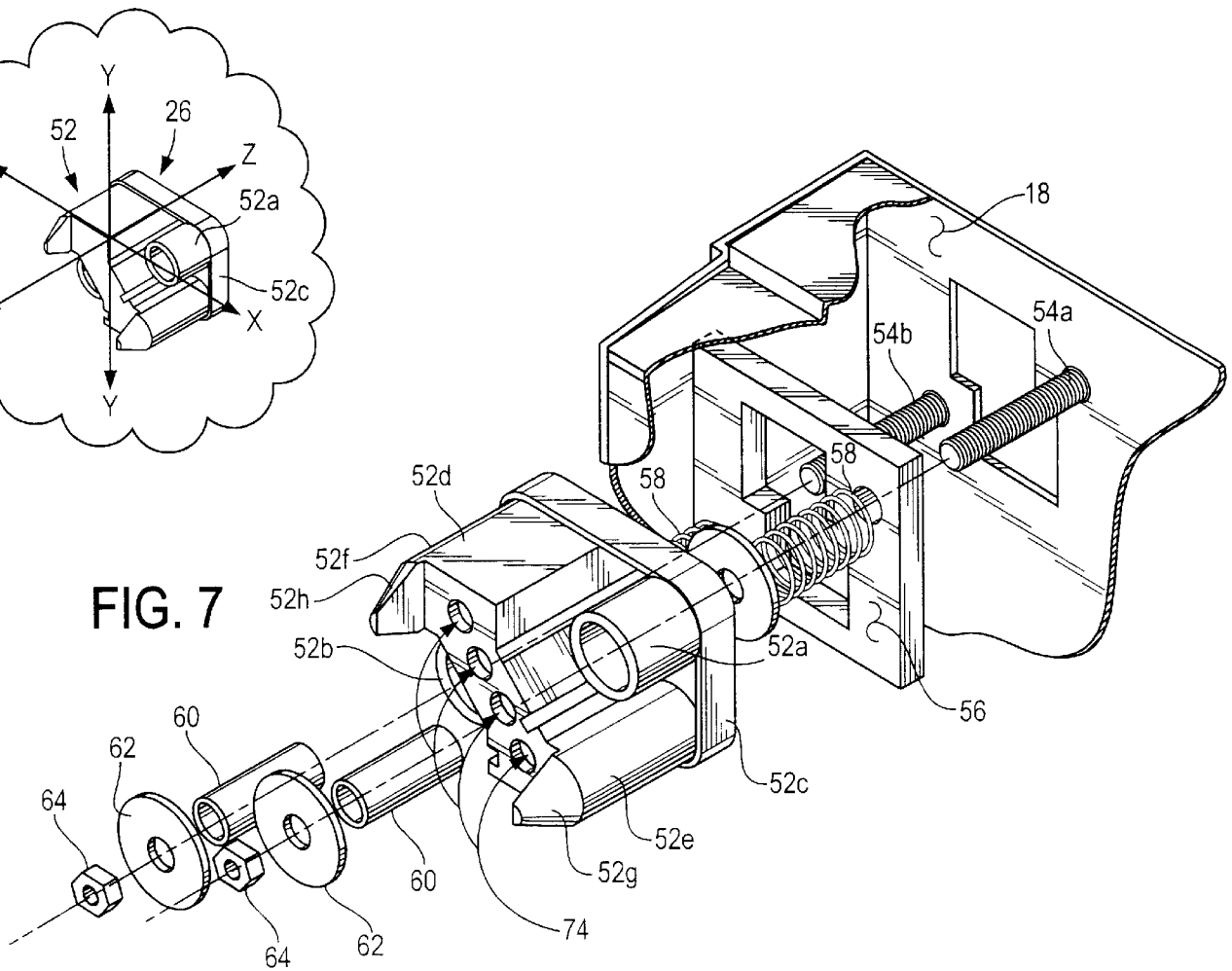
FIG. 7 is a fragmentary exploded perspective view illustrating the plug portion of the blind mate connection of FIG. 6.
Figure 7A:
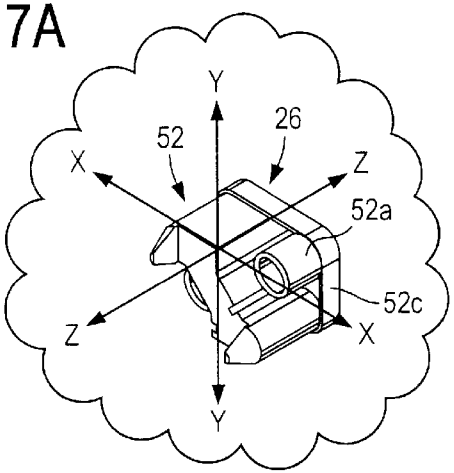
FIG. 7A is a perspective view of the plug of FIG. 7 oriented with X, Y, Z coordinates.

As shown in FIG. 7, the radial float plug connector 26 includes a float plug 52 that may be made of molded plastic and has a pair of tubular guide sleeves 52*a* and 52*b* formed integral with or otherwise secured to a base 52*c* so as to facilitate mounting of the float plug on the cell end plate 18 through a pair of threaded stub shafts 54*a* and 54*b* fixed in normal relation to the cell male end plate 18. A spacer plate 56 and compression springs 58 are mounted on the stub shafts 54*a,b* between end wall 18 and the float plug 52 so as to enable movement of the plug along the stub shafts, designated as the Z-axis in FIG. 7A, against the outward biasing of the springs 58. Spacer sleeves 60, washers 62 and nuts 64 maintain the float plug 52 on stub shafts 54*a,b* in a manner enabling movement of the float plug in the X and Y axis directions designated in FIG. 7A, thereby allowing the float plug to float in the X, Y and Z directions relative to end plate 18.

The float plug 52 includes a boss portion 52*d* having rounded comers 52*e* and 52*f* and tapered ends 52*g* and 52*h* that serve to slidingly guide the plug into a suitably configured recess or socket formed in a block 70 of the axially opposed receptacle connector 28 of the blind mate connector. The block 70 is fixed to the female end plate 20 of the associated modular cell 16 and carries a plurality of electrically conductive receptacle pins 72 (FIG. 6) that are connected to a low voltage (i.e., 24 v–240 v) input power distribution network, as will be described. The electrical receptacle pins 72 are pointed and guided into cylindrical plug socket contacts 74 formed in the boss portion 52*d* of float plug 52 as the plug connector 26 and receptacle connector 28 are mated. By mounting the float plug 52 for floating movement in the X, Y and Z axes, it will be appreciated that as the plug connector 26 and receptacle connector 28 are brought into mating relation, the float plug tapered lead ends 52*g, h* will enter the recess of the receptacle connector block 70 and orient or align the float plug with the connector block so that the receptacle pins 72 enter the plug socket contacts 74 and make electrical contact therewith even though the two adjacent modular cells 16 are not in exact alignment as they are initially brought into nested relation on the rack 12.

Figure 6:
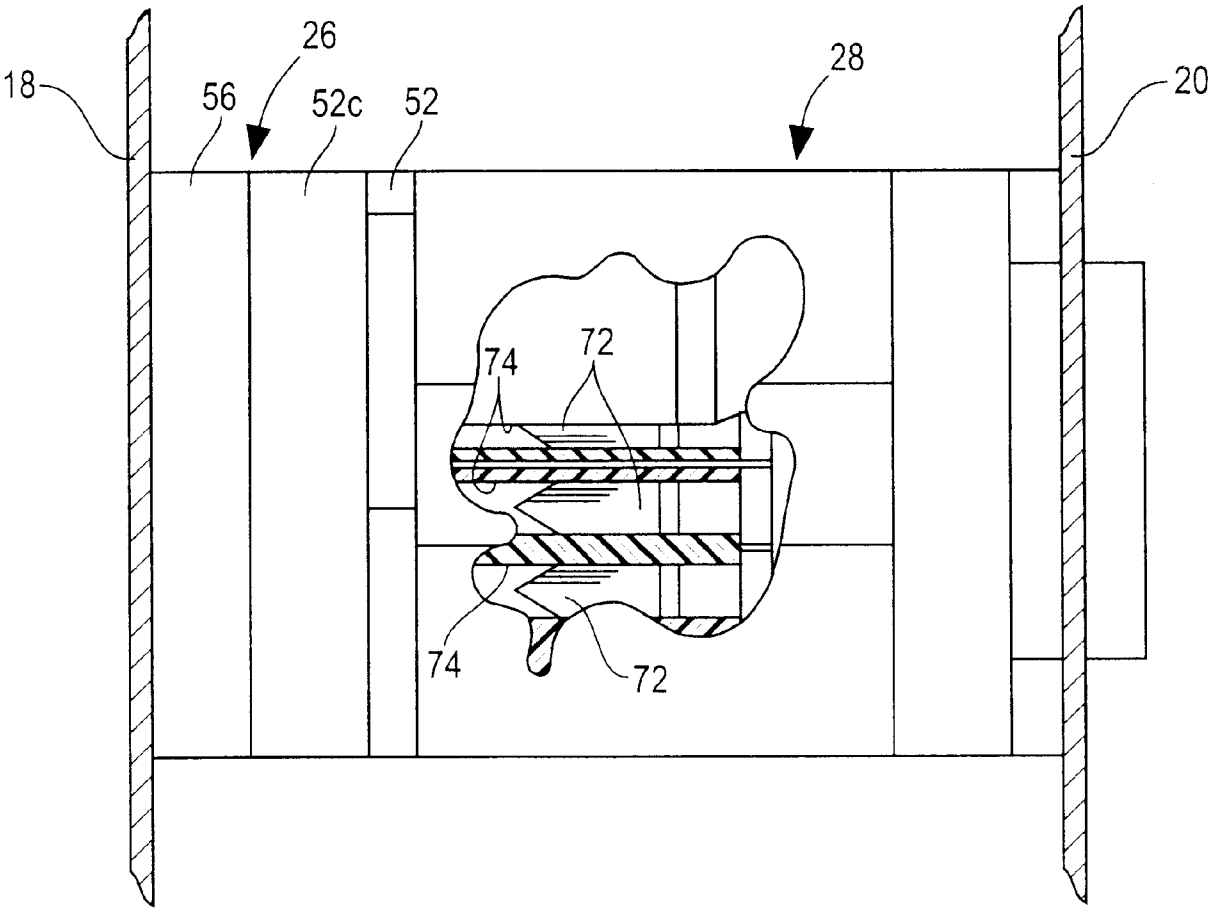
FIG. 6 is a fragmentary detail view showing a typical radial float blind mate mechanical/electrical power connection between modular cells.

Referring to FIG. 5, a low voltage flexible wiring harness 76 having insulated electrical conductor cables connects and electrically unites the two float plug and receptacle connector halves 26 and 28 mounted on the opposite end plates 18 and 20 of each modular cell 16. The low voltage harness 76 is protected from air borne particulate and shielded from the high voltage field by a barrier 78. When adjacent modular cells 16 are fully nested together and plug sockets 74 mate with receptacle pins 72, an additional contaminate free environment for cell-to-cell connections is created within the inner walls of the radial float "blind mate" connectors 26 and 28, as shown in FIG. 6. When a plurality of modular ionizer/collector cells 16 are connected in a tier, such as on the rack 12, an input power source is connected to the radial float connector means on the first cell in the tier. If multiple tiers of cells are supported on the rack, the first cells of the tiers are electrically connected together with flexible cables. The cells of each tier are electrically connected in a parallel circuit and joined end-to-end with the floating plug connector 26 of each cell mating into the receptacle connector 28 on the next adjacent cell.

As shown in FIGS. 5 and 8, a power supply 24 is integrated into each ionizer/collector cell 16. The power supply 24 is affixed to the outer face of the male flange end plate 18 with mounting hardware. The power supply 24 is enclosed and sealed to protect against moisture, dust and foreign matter. A free hanging power supply connector 32 is used to connect the low voltage cable 36 from the power supply 24 to the wiring harness 76. The high voltage connection from power supply 24 can be made either from the back surface of the power supply 24 enclosure to an ionizer/collector cell insulator 82 (FIG. 8), or to a high voltage cable 34 which would be connected to the ionizer/ collector cell insulator 82. The power supply 24 of each individual ionizer/collector cell 16 includes a power status indicator in the form of a light, such as a light emitting diode indicated at 84 in FIG. 8, that is a sub-component of the power supply.

Figure 9:
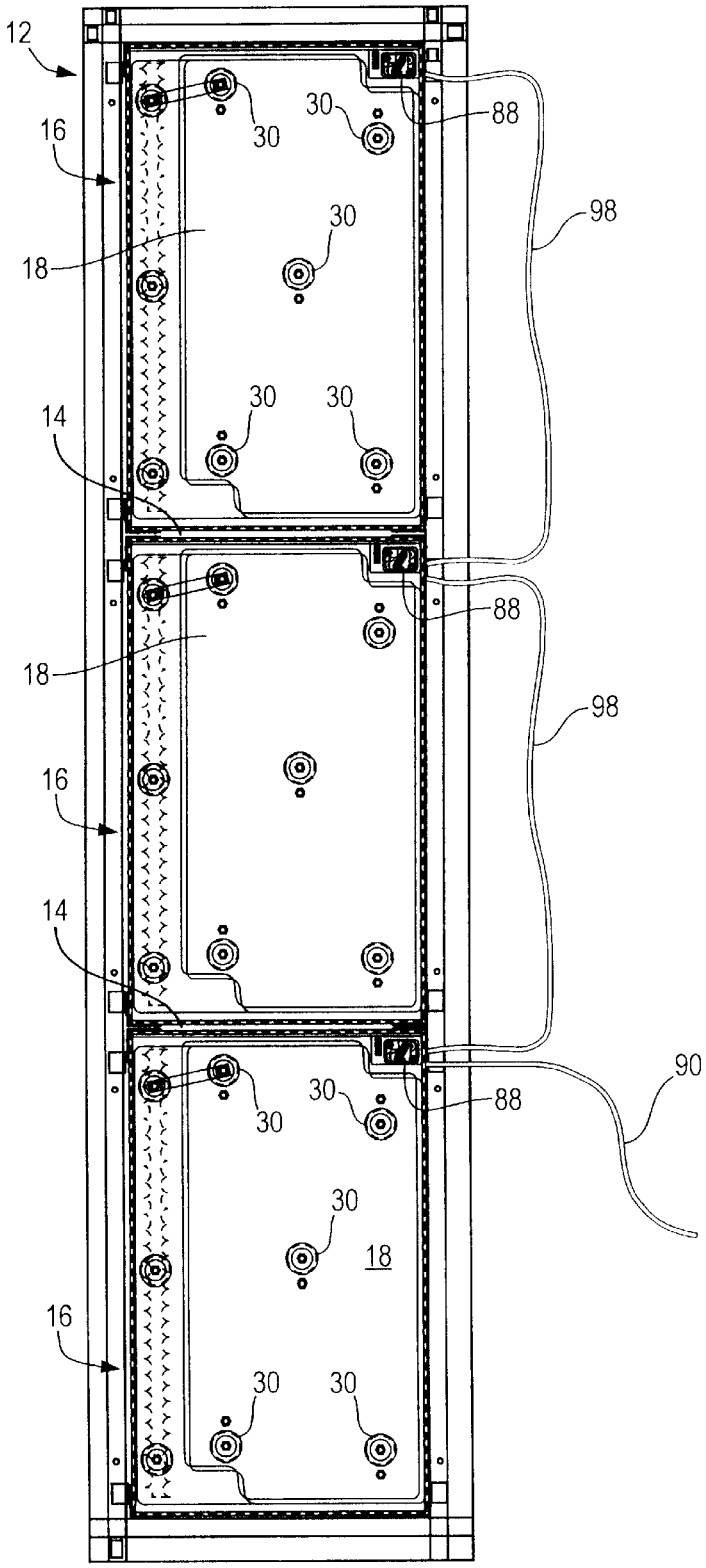
FIG. 9 is an elevational view from the power distribution end of a representative electrostatic precipitation system, showing power distribution PCB modules and cable connections between tiers of ESP modules.
Figure 10:
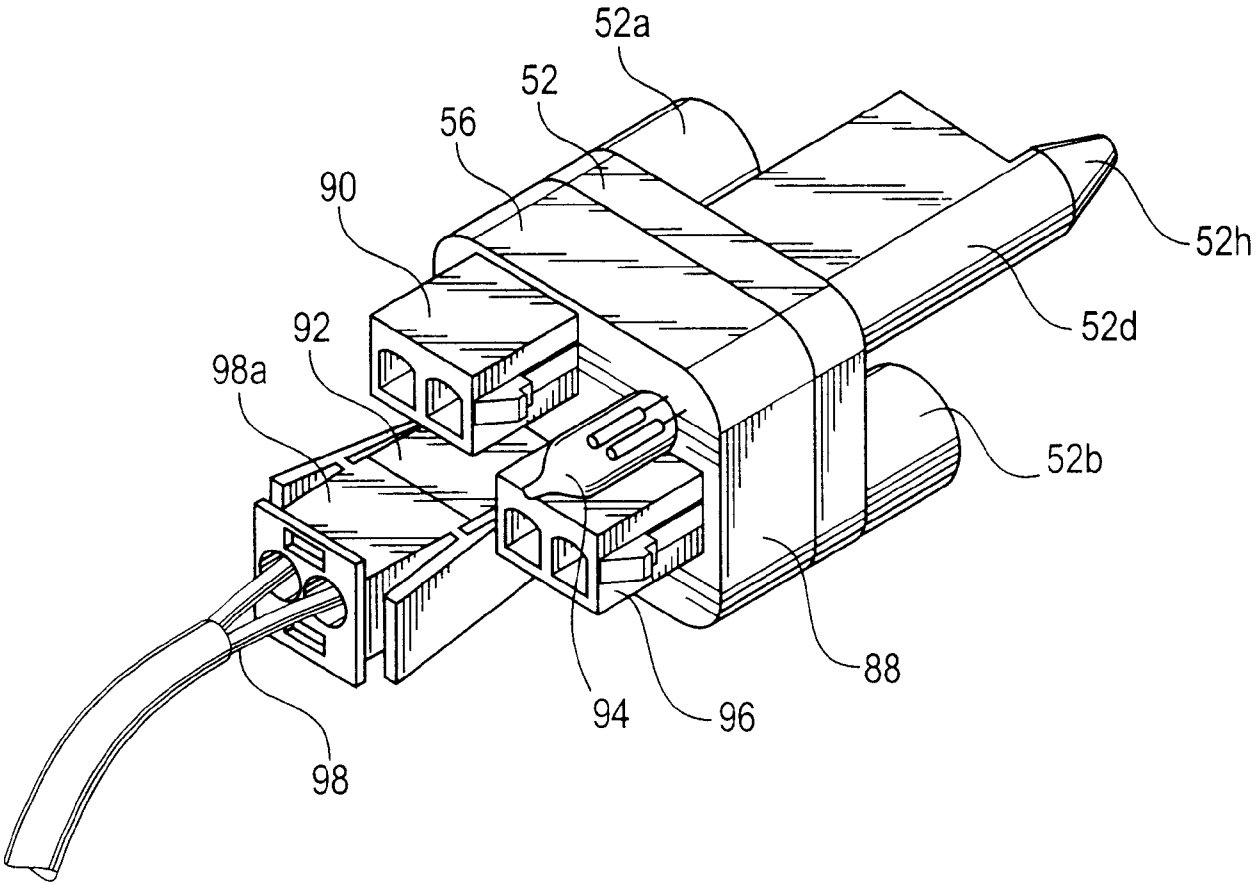
FIG. 10 is a perspective view of a power distribution module as employed in the system of FIG. 9.

Referring to FIG. 9, taken in conjunction with FIG. 10, each tier or row of ionizer/collector cells 16 on the rack 12 includes a power distribution module 88 adapted to plug into the receptacle half of the radial float "blind mate" connector 28 on the first ionizer/collector cell of a tier or row. That is, the first cell mounted on the rack to create a tier or row of cells. Each power distribution module 88 serves as a distribution point for electrically conducting power and signals to each tier of the ESP system 10. Each power distribution module 88 has four primary components; a power input connector 90, a tier-to-tier power distribution connector 92, a tier status indicator 94, and a tier status auxiliary connector 96, as shown in FIG. 10. The power input connector 90 functions as a receptacle for the primary power cord plug. The tier power distribution connector 92 functions as a receptacle for a power jumper cable 98 and associated plug 98*a* that extend between tiers on the ESP system. The power distribution connector 92 is not used on single tier systems. The tier status indicator 94 functions as a operating status light. When the light is illuminated, all cells 16 on the associated tier are functioning properly. When the light is blinking, one or more cells 16 on the associated tier are arcing. When the light is not illuminated or blinking, one or more cells 16 on the associated tier will be shorted, or one or more cells may have a faulty connection, or one or more cells will have a faulty power supply 24.

Figure 11:
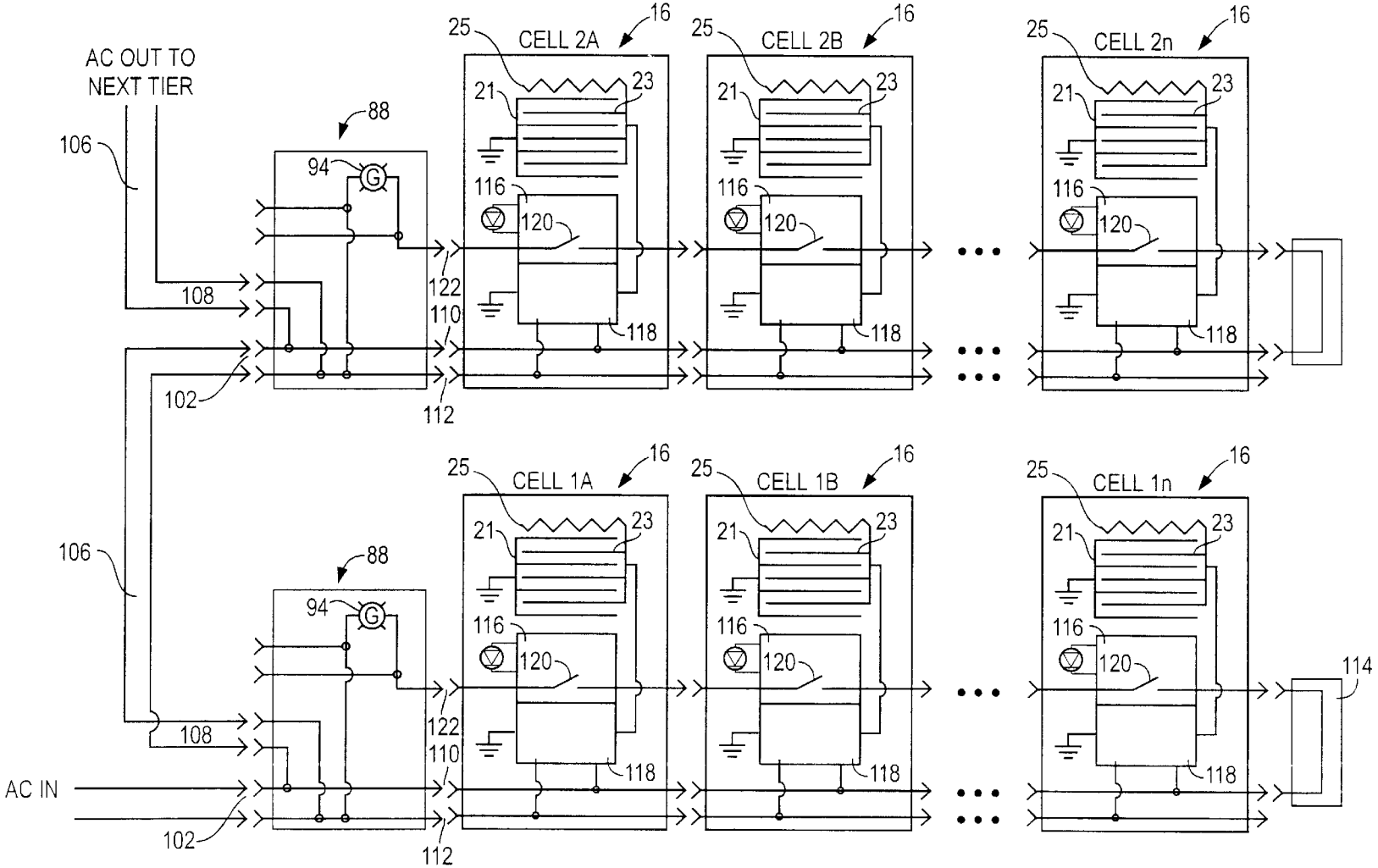
FIG. 11 is a schematic electrical diagram illustrating power distribution and operating status signals for the modular electrostatic precipitation cells as employed in the system of FIG. 1.

FIG. 11 schematically illustrates an electrical circuit for effecting power distribution and operating status signals for a representative two tier system of electrostatic precipitating cells 16. AC power is plugged into a power input connector 102 on a power distribution module 88. If more than one tier of cells is employed, a tier-to-tier cable 106 is plugged into a tier-to-tier power distribution connector 108 on each tier. AC power is connected to the first cell on each tier through pins 110 and 112 to the radial float receptacle 26 which is accessible through a suitable opening in the end plate 18. Power then is distributed to each cell on the associated tier through each radial float connector pair 26, 28. Each cell power supply is connected to the AC power line 110 and 112. The AC power on pins 110 is looped through a tier end plate 114 and back to power supply status control circuits 116. If a power supply 118 is functioning properly, each power supply status control electronic switch 120 will close thus passing AC current to the power supply in the next adjacent ionizer/collector cell 16.

If all power supplies 118 are functioning properly, all power status control electronic switches 120 will be closed and AC current will pass through the radial float connector pin 122, thus illuminating the tier status light 94 to indicate that all cells 16 on the associated tier are operating properly.

Summarizing, the ESP system 10 of the present invention has a power supply 24 united or integrated into each ionizer/collector cell 16, whereby the power supply and cell are one unit. A power status indicator display is built into each cell 16 so that each cell is provided with a visual display device, for example an LED 84, that indicates normal operating condition when illuminated. An individual alarm system is also preferably provided on each cell connected in an input signal circuit that triggers an alarm during an open or short circuit condition. Each cell 16 has a sealed power supply 24 that protects the cell power supply components in a watertight enclosure that can withstand submersion in a water-based cleaning solution during routine maintenance operations. Further, the ability to effect cell nesting (male and female end plates) creates a protective cavity for electrical components. Each cell module has two end plates, a plug (male) 18 and receptacle (female) 20, which serve as a support platform for the cell structure. Each end plate 18, 20 has an outward-formed flange around its perimeter which forms a pocket or cavity. The plug or male end plate flange is preferably extended to approximately twice the depth of the female end plate flange. An offset has been added to the extended plug flange, which allows it to nest inside the female receptacle end plate. When connected end-to-end, the ionizer/collector cells 16 literally plug together (nest) forming a protective closed cavity. As a result of this arrangement, cell nesting corrects any misalignment between cells, and provides an air-stream baffle between end-to-end connected cells.

A feature of the ESP system 10 is that each cell 16 has a radial float "blind mate" connector. Each connector has two components, a radial float plug 26 with socket contacts and a affixed mount receptacle 28 with pin contacts. The radial float plug 26 is mounted to one cell end plate and secured with hardware that allows limited 3-dimensional movement of the plug on a generally flat surface. The fixed mount receptacle 28 is secured firmly with hardware to the opposite end plate of the same cell. When cells are pushed end-to-end in a tier arrangement, the plug from one cell end plate will self-align and fully engage with the receptacle of an adjacent cell. This radial float blind mate connector arrangement corrects for misalignment during cell-to-cell connection. Due to the unique floating design of the connector components 26 and 28, misalignment up to three sixteenths of an inch can be overcome during connection of different ionizer/collector cells. Further, the radial float blind mate connector seals against air borne contaminates, By integrating a perforated non-metallic pre-filter and metallic post-filter 48 and 50, respectively, into each ionizer/collector cells 16, and mechanically affixing the post-filter to the grounded cell frame, an additional surface is created for attraction of opposite charged particles thereby improving efficiency. A further feature lies in the use of flexible cables with plugs (rated 24 V–240 V) as field connections, and the use of an integrated cable barrier to isolate the low voltage circuit from the high voltage circuit. The power cable is designed to place the fault system in series on an infinite number of cells.

In accordance with the preferred embodiment, one or more ionizer/collector cells 16 may be connected end-to-end form a tier and a power distribution printed circuit board (PCB) module is incorporated into each tier. Each tier of cells has a built-in-visual display that illuminates under normal operating conditions. Further, each tier preferably has a connection port that is integrated into the tier status circuit to provide a means to connect external devices for monitoring tier status. When one or more ionizer/collector cell tiers are present in an ESP system, flexible cables with plugs at each end are preferably provided to transport power between each tier. Further, each cell 16 includes a status circuit that detects faulty electrical connection, monitors short circuit conditions in cells, monitors power supply failure, or monitors cell arcing. No low or high voltage hard wiring is necessary, nor are cell high voltage contacts necessary.

While preferred embodiments of various components of a modular cell electrostatic precipitator system have been illustrated and described, it will be understood that changes and modifications may be made therein without departing from the invention in its broader aspects. Various features of the invention are defined in the following claims.

What is claimed is:

1. An ionizer/collector cell for an electrostatic precipitator comprising a plurality of collector plates supported in substantially parallel spaced relation, and a pair of end plates disposed at opposite ends of said collector plates, said end plates each having a generally planar portion and a flange extending in a direction forwardly from said generally planar portion, said flange on one of said end plates being configurated to enable nesting with an opposite end plate on an adjacent cell and create a protective cavity between the nested cells.

2. An ionizer/collector cell as defined in claim 1 wherein said flanges on said end plates extend about the full peripheries of the generally planar portions of said end plates so that a protective closed cavity is formed between nested cells.

3. An ionizer/collector cell as defined in claim 1 wherein said flanges on said end plates are configured to effect a sealed cavity when end plates on adjacent generally axially aligned cells are in nested relation.

4. An ionizer/collector cell as defined in claim 1 wherein said cell includes a power supply supported on one of said end plates.

5. An ionizer/collector cell as defined in claim 4 wherein said cell includes a status indicator display adapted to indicate that the cell is in an operating condition when said power supply is connected to a predetermined electrical power source.

6. An ionizer/collector cell as defined in claim 5 wherein said indicator display is operative to provide a visual display when said cell is in said operating condition.

7. An ionizer/collector cell as defined in claim 6 wherein said visual display comprises an L.E.D. operative to illuminate when said cell is connected to an electrical power supply.

8. An ionizer/collector cell as defined in claim 1 wherein said flanges on said end plates establish an air stream baffle when said end plates are in nested relation with end plates on adjacent cells.

9. An ionizer/collector cell as defined in claim 1 wherein said collector plates are supported in a grounded support frame and have opposite side substantially coplanar marginal edges defining air input and air exhaust sides of said cell, said cell having a perforated metallic post-filter disposed adjacent said air exhaust side of said cell and affixed to said grounded frame so as to attract positively charged particles passing outwardly from said exhaust side of said cell.

10. An ionizer/collector cell as defined in claim 9 including a nonmetallic perforated pre-filter disposed adjacent said air input side of said cell so that air passing into said air input side of said cell first passes through said pre-filter.

11. An ionizer/collector cell for an electrostatic precipitator comprising a plurality of collector plates supported in substantial parallel spaced relation, and a pair of end plates disposed at opposite ends of said collector plates, said end plates each having a generally planar portion and flange extending outwardly from said generally planar portion, said flange on one of said end plates being tapered inwardly from a position normal to said generally planar portion of said end plates so as to facilitate nesting with an opposite end plate on an adjacent cell and create a protective cavity between the nested cells when the adjacent cells are not in exact axial alignment.

12. An ionizer/collector cell as defined in claim 11 wherein said tapered flange on said one of said end plates is configured to cause the nested cells to axially align with each other when brought into nested relation from non-axially aligned positions.

13. An ionizer/collector cell as defined in claim 11 wherein said tapered flange has a depth in the axial direction of said cell greater than the axial depth of the flange on the opposite end of said cell.

14. An ionizer/collector cell for an electrostatic precipitator comprising a plurality of collector plates supported in substantially parallel spaced relation, and a pair of end plates disposed at opposite ends of said collector plates, said end plates each having a generally planar portion and a flange extending outwardly from said generally planar portion, said flange on one of said end plates being configured to enable nesting with an opposite end plate on an adjacent cell and create a protective cavity between the nested cells, said pair of end plates having blind mate connector means thereon for transferring electrical power between adjacent cells when in nested relation, said connector means being capable of electrically interconnecting adjacent cells when brought into nested relation from axially non-aligned positions.

15. An ionizer/collector cell as defined in claim 14 wherein said connector means comprises a radial float plug connector supported on one of said pair of end plates, a fixed position receptacle connector supported on the other of said end plates, and an electrical conductor interconnecting said float plug connector and said receptacle connector, said radial float plug connector being connectable to a receptacle connector on an adjacent cell when said adjacent cells are connected in nested relation.

16. An ionizer/collector cell as defined in claim 15 wherein said radial float plug connector is supported on said one end plate in a manner to enable movement of said plug connector in a generally X, Y and Z axis orientation wherein the Z axis is normal to said one end plate.

17. An ionizer/collector cell as defined in claim 15 wherein a selected one of said plug connector or said receptacle connector carriers a plurality of receptacle pins adapted for connection to a low voltage input power source, the other of said plug connector or receptacle connector having a plurality of socket contacts adapted to receive said receptacle pins so that connecting a pair of said cells in nested relation with a plug connector of one cell connected to a receptacle connector on the adjacent nested cell causes the receptacle pins on said selected connector to be received in socket contacts on said other of said connectors.

18. An ionizer/collector cell as defined in claim 15 including a low voltage wiring harness electrically interconnecting said radial float plug connector and said fixed position receptacle connector supported on said opposite end plates of said cell.

19. An ionizer/collector cell as defined in claim 15 wherein said cell includes a status indicator display operative to provide a visual display when said cell is connected to an electrical power source and operating properly as an ionizer/collector.

20. An ionizer/collector cell as defined in claim 19 wherein said cell includes an input signal circuit operative to generate an alarm signal in the event said cell undergoes a short or open circuit condition during operation of said cell as an electrostatic precipitator.

21. An ionizer/collector cell for an electrostatic precipitator comprising a plurality of collector plates supported in substantially parallel spaced relation, a pair of end plates disposed at opposite ends of said collector plates, a radial float plug connector supported on one of said pair of end plates, a fixed position receptacle connector supported on the other of said end plates, said radial float plug connector and said receptacle connector being positioned on their corresponding end plates so that the radial float plug connector is connectable to a receptacle connector on an adjacent cell when said adjacent cells are connected in substantially axially aligned relation, and an electrical conductor interconnecting said float plug connector and said receptacle connector on said cell.

22. An ionizer/collector cell as defined in claim 21 wherein said radial A float plug connector is supported on said one end plate in a manner to enable movement of said plug connector in a generally X, Y and Z axis orientation wherein the Z axis is normal to said one end plate.

23. An ionizer/collector cell as defined in claim 21 wherein said end plates each have a generally planar portion and a flange extending outwardly from said generally planar portion, said flange on one of said end plates being configurated to enable nesting with an opposite end plate on an adjacent cell and create a protective cavity between the nested cells.

24. An ionizer/collector cell as defined in claim 23 wherein said flanges on said end plates extend about the full peripheries of the generally planar portions of said end plates so that a protective closed cavity is formed between nested cells.

25. An ionizer/collector cell as defined in claim 24 wherein said flange on said one of said end plates is tapered inwardly from a position normal to said generally planar portion of said end plate so as to facilitate nesting with an opposite end plate on an adjacent cell when the adjacent cells are not in exact axial alignment.

26. An ionizer/collector cell as defined in claim 25 wherein said tapered flange on said one of said end plates is configured to cause the nested cells to axially align with each other when brought into nested relation from non-axially aligned positions.

27. An ionizer/collector cell as defined in claim 24 wherein said flanges on said end plates are configured to effect a sealed cavity when end plates on adjacent generally axially aligned cells are in nested relation.

28. An electrostatic precipitator system for extracting airborne particles, said system including a plurality of individual ionizer/collector cell modules each of which includes a pair of end plates having a generally planar portion and a flange extending outwardly at an angle from said generally planar portion so as to enable adjacent generally axially aligned cell modules to be joined blindly to one another in end-to-end nested relation in a series circuit, said flanges on said end plates being mutually cooperable to provide self-correction of misaligned adjacent cells during end-to-end connection and establishing substantially sealed cavities between nested cells for receiving a power supply and electrical connections.

29. An electrostatic precipitator system as defined in claim 28 wherein said flanges on said end plates extend about the full peripheries of the generally planar portions of said end plates.

30. An electrostatic precipitator system as defined in claim 29 wherein the flange on a selected one of each pair of said end plates is tapered inwardly from a position normal to said generally planar portion of said end plate so as to facilitate nesting with an opposite end plate on an adjacent cell when the adjacent cells are not in exact axial alignment.

31. An electrostatic precipitator system as defined in claim 28 wherein said end plates on each modular cell have blind mate connector means for transferring electrical power between adjacent cells when in nested relation, said connector means being capable of electrically interconnecting adjacent cells when brought into nested relation.

32. An electrostatic precipitator system as defined in claim 28 wherein each of said modular cells includes a power supply supported on one of its said end plates.

33. An electrostatic precipitator system as defined in claim 28 wherein each of said cells includes a status indicator display adapted to indicate that the cell is in an operating condition when said power supply is connected to a predetermined electrical power source.

34. An electrostatic precipitator system as defined in claim 28 wherein said display comprises an L.E.D. operative to illuminate when said cell is connected to an electrical power supply.

35. An electrostatic precipitator system as defined in claim 28 wherein said flanges on said end plates establish an air stream baffle when said end plates are in nested relation with end plates on adjacent cells.

36. An electrostatic precipitator system for extracting airborne particles, said system including a plurality of individual ionizer/collector cell modules having end plates that enable adjacent generally axially aligned cell modules to be joined blindly to one another in end-to-end nested relation in a series circuit, said end plates providing self-correction of misaligned adjacent cells during end-to-end connection and establishing sealed cavities between nested cells for receiving a power supply and electrical connections, said end plates on each modular cell having blind mate connector means comprising a radial float plug connector supported on one of said end plates, and a fixed position receptacle connector supported on the other of said end plates, said radial float plug connector being connectable to a receptacle connector on an adjacent cell so as to electrically interconnect adjacent cells when said adjacent cells are connected in nested relation.

37. An electrostatic precipitator system as defined in claim 36 wherein said radial float plug connector is supported on said one end plate in a manner to enable movement of said plug connector in a generally X, Y and Z axis orientation wherein axis Z axis is normal to said one end plate.

* * * * *